US009682840B2

(12) United States Patent
Echerer

(10) Patent No.: US 9,682,840 B2
(45) Date of Patent: Jun. 20, 2017

(54) FOLDING ROLLER WITH RUBBER-ELASTIC INSERTS

(71) Applicant: manroland web systems GmbH, Augsburg (DE)

(72) Inventor: Siegmund Echerer, Thierhaupten (DE)

(73) Assignee: manroland web systems GmbH, Augsburg (DE)

( * ) Notice: Subject to any disclaimer, the term of this patent is extended or adjusted under 35 U.S.C. 154(b) by 0 days.

(21) Appl. No.: 14/720,353

(22) Filed: May 22, 2015

(65) Prior Publication Data

US 2015/0336764 A1 Nov. 26, 2015

(30) Foreign Application Priority Data

May 23, 2014 (DE) ..... 10 2014 007 495

(51) Int. Cl.
*B65H 37/06* (2006.01)
*B65H 45/16* (2006.01)
*B65H 45/18* (2006.01)

(52) U.S. Cl.
CPC ..... *B65H 45/16* (2013.01); *B65H 45/161* (2013.01); *B65H 45/18* (2013.01); *B65H 2404/1316* (2013.01)

(58) Field of Classification Search
CPC ..... B65H 37/06; B65H 45/16; B65H 45/161; B65H 45/18
USPC ..... 270/32, 39.8; 493/444, 445
See application file for complete search history.

(56) References Cited

U.S. PATENT DOCUMENTS 2,423,407 A * 7/1947 Searles ..... B65G 39/06 198/830
3,310,160 A * 3/1967 Reilly ..... B65G 39/06 198/827
3,796,423 A * 3/1974 Shuster ..... B65H 27/00 100/176
4,718,544 A * 1/1988 Herren ..... B65G 39/07 198/843
5,007,891 A * 4/1991 von Hein ..... B65H 45/161 493/444
5,284,457 A * 2/1994 Gerstenberger ..... F16D 1/0858 198/836.4

(Continued)

FOREIGN PATENT DOCUMENTS

DE 574 360 A 4/1933
DE 27 10 575 A1 9/1978

(Continued)

OTHER PUBLICATIONS https://www.ahdictionary.com/word/search.html?q=insert.*
https://www.ahdictionary.com/word/search.html?q=rubber.*

*Primary Examiner* — Patrick Mackey
(74) *Attorney, Agent, or Firm* — Crowell & Moring LLP

(57) ABSTRACT

A folding roller for use in a folding device for folding a fold is disclosed. At the folding device a substrate to be folded is pushed into an inlet roller nip of folding rollers rotating in opposite directions by a folding knife for forming a fold. The folded-away substrate is transferred from the folding rollers to a belt line guided about the folding rollers and consisting of transport belts for the purpose of onward transporting the folded product. The folding roller in the regions in axial extension in which at least one transport belt at least partially wraps the folding roller includes at least one rubber-elastic insert.

14 Claims, 8 Drawing Sheets

(56) References Cited

U.S. PATENT DOCUMENTS

2004/0157716 A1 8/2004 Echerer et al.

FOREIGN PATENT DOCUMENTS

| | | | |
|---|---|---|---|
| DE | 28 37 392 | C3 | 2/1980 |
| DE | 38 36 342 | A1 | 4/1990 |
| DE | 197 02 252 | A1 | 7/1998 |
| DE | 199 56 248 | A1 | 5/2001 |
| DE | 103 04 534 | A1 | 8/2004 |
| DE | 699 16 748 | T2 | 3/2005 |
| EP | 1 000 894 | A2 | 5/2000 |

* cited by examiner

FOLDING ROLLER WITH RUBBER-ELASTIC INSERTS

This application claims the priority of German Patent Document No. DE 10 2014 007 495.1, filed May 23, 2014, the disclosure of which is expressly incorporated by reference herein.

BACKGROUND AND SUMMARY OF THE INVENTION

The invention relates to a folding roller comprising on its outer shell surface rubber-elastic inserts on which roll the transport belts which at least partially wrap the folding roller. Furthermore, the invention relates to a device for forming folds, which comprises a folding roller according to the invention.

For forming folds of sheets or webs printed for example in offset, intaglio or inkjet printing machines which are separated into sheets prior to the folding operation, a so-called knife folding or chopper folding device is known from the prior art. Such a device generally consists of a folding table with a recess on which the sheet to be folded comes to lie. For forming the fold, the sheet is pressed by a folding knife through the recess of the folding table into the inlet nip of two folding rollers rotating in opposite directions. With their outer shell surfaces, the folding rollers grip the sheets, conveying these into a belt line subject to forming a fold which runs parallel to the axis of rotation of the folding rollers. This belt line usually consists of multiple transport belts arranged at a certain distance next to one another, which at least partially wrap the folding rollers. The basic function principle of such a folding device is described for example in DE574360 or in DE2837392 C3.

The folding rollers that are employed with such folding devices are likewise known from the prior art. Accordingly, DE3836342 A1 discloses a so-called clocked folding roller which does not comprise a continuous cylindrical outer shell surface. DE19956248 A1 discloses folding rollers with partial recesses in the outer shell surface of the folding roller, DE19702252 A1 describes a folding roller with a folding bar extending axially parallel alongside the folding roller. DE10304534 A1 discloses a folding roller which has a friction layer on certain parts of the shell surface.

All the folding rollers known according to the prior art however comprise transport belts circulating on these, which directly roll on the folding roller body. To ensure a unique position, these transport belts generally run in grooves extending in the circumferential direction. The transport belts employed for this purpose generally have a friction coefficient that is higher compared with the shell surface of the folding roller since the transport belts have to ensure the secure and clocked transport of the folded sheets even after the forming of the fold.

For this reason, the grooves in the folding rollers are generally dimensioned in such a manner that the transport belt slightly protrudes over the outer shell surface of the folding roller. In principle it is also possible that the at least one transport belt lies on the outer shell surface of the folding roller body and the folding roller body thus does not have a circumferential groove or grooves, which is dependent on the substrate and the folding quality to be expected. If applicable, more transport belts are required with this embodiment over the axial extension of the folding roller to ensure a more homogeneous shell surface.

In particular with thin folding products or folding products from a substrate having less grip the correct adjustment of the folding roller nip relative to the product thickness is extremely important. Too large a folding roller nip can result in that either the fold is not formed neatly or that the sheet pressed into the folding roller nip by the folding knife is not gripped by the folding rollers and thus not folded away, which leads to so-called stoppers. Too narrow a folding roller nip generally leads to squashed folds or other damage to the folded sheets and can additionally lead to huge wear of folding rollers, transport belts and/or of the folding knife.

Since through the folding operation the transport belts in particular are subject to a certain wear even with correct adjustment of the folding roller nip, the protrusion of the belts relative to the folding roller shell surface changes, which on the one hand requires readjustment of the folding roller nip and on the other hand renders the adjustment of the folding roller nip even more sensitive in particular with critical productions.

With respect to the wear but also to the transport behavior of the transport belts an aggravating fact is that the system folding roller—transport belt according to the known prior art has hardly any elasticity since the transport belts which generally are only approximately 1 to 2 mm thick and because of this the transport belts which are very stiff in this alignment run on the hard, generally metallic folding roller bodies.

The invention is therefore based on the object of creating a solution with which on the one hand the wear of the transport belts can be reduced and at the same time the adjustment of the folding rollers or of the folding roller nip can be configured less sensitive and thus less susceptible to failure.

The device according to the invention comprises a folding roller, which in at least one region in axial extension, in which at least one transport belt each wraps the folding rollers at least partially, comprises at least one rubber-elastic insert.

Such an embodiment of the folding rollers has the advantage that the at least one transport belt of the belt line does not rest on the rigid and thus inflexible folding roller body or in a circumferential groove provided on the folding roller body, so that through the rubber-elastic insert the transport belt is resilient in the radial direction of the folding roller. Because of this, a transport belt can yield parallel to the axis of rotation of the folding rollers in the radial direction when the folding knife dips into the folding roller nip and while the sheet to be folded is pressed into the folding roller nip for forming a fold which takes place because of this. On the one hand, this has the advantage that the wear of the respective transport belt compared with the prior art, with which the transport belt lies on the hard, mostly metallic and thus inflexible folding roller body or in a circumferential groove provided on the folding roller body, is significantly reduced. On the other hand, through the resilience the sensitivity of the adjustment of the folding roller nip is clearly reduced, i.e., in particular when folding thin folding products or folding products of a substrate with little grip or corresponding coating, the risk of stoppers in the case of a folding roller nip that is too small or too large or folding problems such as doubling or damage to the substrate surface with too small a folding roller nip can be noticeably reduced.

Here, there is no difference with regard to the just mentioned advantages whether the rubber-elastic insert has a width which at least corresponds to the width of the transport belt so that the transport belt over its entire width lies on the rubber-elastic insert, or if the rubber-elastic insert has a width which is smaller than the width of a transport belt so that the transport belt only partially lies on the rubber-elastic insert. For it is substantial that in at least one region over the transport belt width, in which the transport belt lies on the rubber-elastic support, a larger protrusion in the radial extension of the folding roller is present than in the regions over the width of the transport belt, in which the transport belt if appropriate does not rest on the rubber-elastic support.

In a form of the invention, the rubber-elastic insert consists of a compressible material. The advantage in this case is that when dimensioning the groove for the insert no consideration has to be given to the change in shape and the insert thus does not change for example the position relative to the folding roller body. A particular advantage of this form is the possibility of not producing the insert from one or multiple closed rings of rubber-elastic material, but to embody these as a strip with finite extension, preferentially this extension corresponds to the circumference of the respective groove. This form of the invention is explained in more detail later on.

In a further advantageous form of the invention, the rubber-elastic insert consists of incompressible material. Such a configuration offers for example the advantage that as an insert commercially available rings of rubber-like material such as for example NBR-70 or polyurethane, which are available in a large assortment and at favorable costs, which renders the procurement as well as the availability advantageous for the producer and also for the end user, can be used. Accordingly, rubber rings with a diameter of the cross-section of 2 to 10 mm can be employed for example.

Accordingly, in a further advantageous configuration of the invention, at least one rubber-elastic ring can be employed as rubber-elastic insert in each case.

This form has the advantage that the insert has no joint or no seam so that in all places in the circumferential direction of the folding roller the insert has the same characteristic. This is required in particular when non-clocked folding rollers, i.e., folding rollers on which the folding operation in the form of the dipping of the folding knife and thus the folding away of the sheets to be folded seen in the circumferential direction of the folding roller always takes place in different positions, are used. However, even with clocked folding rollers, i.e., with folding rollers where the folding operation in the form of the dipping of the folding knife and thus the folding-away of the sheets to be folded always takes place as seen in the circumferential direction of the folding roller in the same position, this embodiment of the insert is advantageous since during the assembly no absolute position of the insert relative to the folding roller body has to be observed.

For the sake of completeness it is additionally mentioned here that these rubber-elastic rings can have any cross-section, such as for example a circular, polygonal or otherwise shaped cross-section. Because of the different behavior if applicable, only the hardnesses of the materials have to be adapted to the respective cross-section in this case.

A substantial advantage of the closed rings as the insert is that these have the same characteristics in the circumferential direction of the folding roller. However, it is disadvantageous with this embodiment that the folding roller has to be removed from the folding roller mounting in order to be able to mount new inserts on the roller.

The effort required for this can be reduced in a further advantageous configuration of the invention when on the folding roller in at least a limited region of axial extension, which is not covered by transport belts, endless, at least one annular insert for stocking is accommodated. Accordingly, in the case of damage or fatigue of the inserts the worn annular and thus closed inserts can be cut open and removed from the folding roller, whereas new annular inserts from the region forming the stock are pushed into the respective groove for the insert without having to disassemble the folding roller for this purpose.

In order to entirely avoid this disassembly of a folding roller a further advantageous form of the invention is that as the insert a strip-like body with finite extension in the longitudinal direction is employed, which is preferentially clamped in the groove for the insert in the form that the insert is fixed on the folding rolling without additional fastening elements. This is effected for example in that the groove for the insert has a cross-section which in the radial direction of the folding roller has a tapering cross-section, for example a trapezium-shaped cross-section.

Such an embodiment has the advantage that for replacing the rubber-elastic insert the folding roller does not have to be disassembled, because of the existing joint of the insert such an embodiment is preferentially employed with clocked folding rollers, i.e., with folding rollers where the dipping of the folding knives in the circumferential direction of the folding roller always occurs in the same place.

A further preferential configuration of the invention is that the rubber-elastic inserts are provided in first regions in axial extension in which in a first operating state the transport belts at least partially wrap the folding roller and at the same time in second regions in axial extension in-turn at least one rubber-elastic insert is provided, so that in the case of a worn insert of the at least one first region, the transport belts in a second operating state are relocated into the places of the second regions. This configuration is possible both with inserts of endless rings and also with inserts of strips of finite extension and reduces the maintenance efforts and thus the down times.

Preferred further developments of the invention are obtained from the following description. Various exemplary embodiments of the invention are explained in more detail with the help of the drawings without being restricted thereto.

DETAILED DESCRIPTION OF THE DRAWINGS

The present invention relates to a folding roller with a cylindrical folding roller body with one or more regions in axial extension, in which in each case at least one transport belt is guided and on which at least one transport belt at least partially wraps the folding roller, and includes at least one rubber-elastic insert.

In addition to this, the invention relates to a device for forming a fold which comprises at least one folding roller according to the invention.

Figure 1:
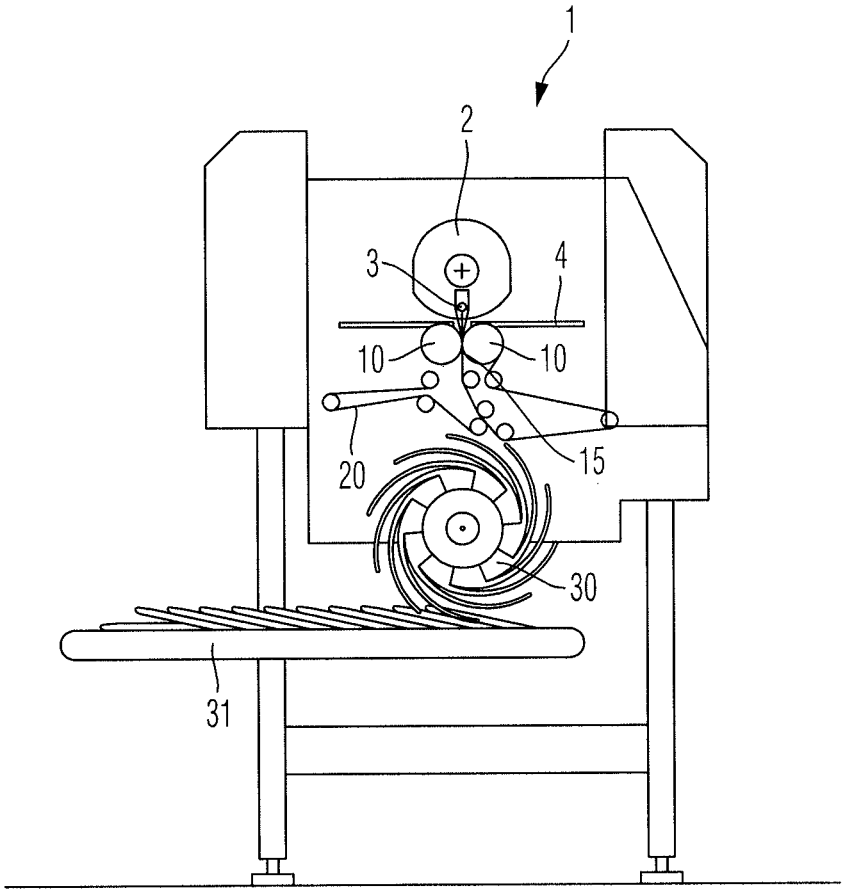
FIG. 1 is a schematic folding device for forming a fold by a folding knife and folding rollers.

FIG. 1 shows schematically a folding device 1 for folding sheets of a substrate, as are employed for example in offset, intaglio or even printing machines with variable print form printing processes such as for example inkjet printing. The sheet to be folded comes to lie on the folding table 4 above the folding rollers 10 and is pushed into the roller nip 15 of the folding rollers 10 by the folding knives 3. As an exemplary embodiment of such a knife folding or chopper folding device, an embodiment with folding drum 2 is shown. Here, the folding drum 2 rotates about its longitudinal axis and comprises a gearing which likewise rotates the folding knife 3 about its longitudinal axis. By suitably matching the geometries of folding drum 2 and folding knife 3, the tip of the folding knife 3 moves on a vertical plane, which preferentially runs through the middle of the folding roller nip. As alternative forms of the folding knife 3, rocker arms are also known in the prior art which perform a rotatoric movement in a plane that is parallel to the axis of rotation of the folding rollers 11. Alternatively, a rocker arm with oscillating movement of a folding knife 2 can likewise be employed, which with its rocking movement pushes the sheet to be folded between the folding rollers.

When the sheet to be folded or the stack of sheets to be folded is pushed into the folding roller nip 15, the same is gripped by the outer shell surface of the folding rollers 10 and the at least one transport belt 21 at least partially wrapping the folding rollers 10 and pulled through the roller nip 15, whereby a fold parallel to the axis of rotation of the folding rollers 11 is formed. The folded product is transported onwards with the belt line 20 with the folding spine up front and delivered on a delivery belt 34 for example via a paddle wheel 30.

Figure 2:
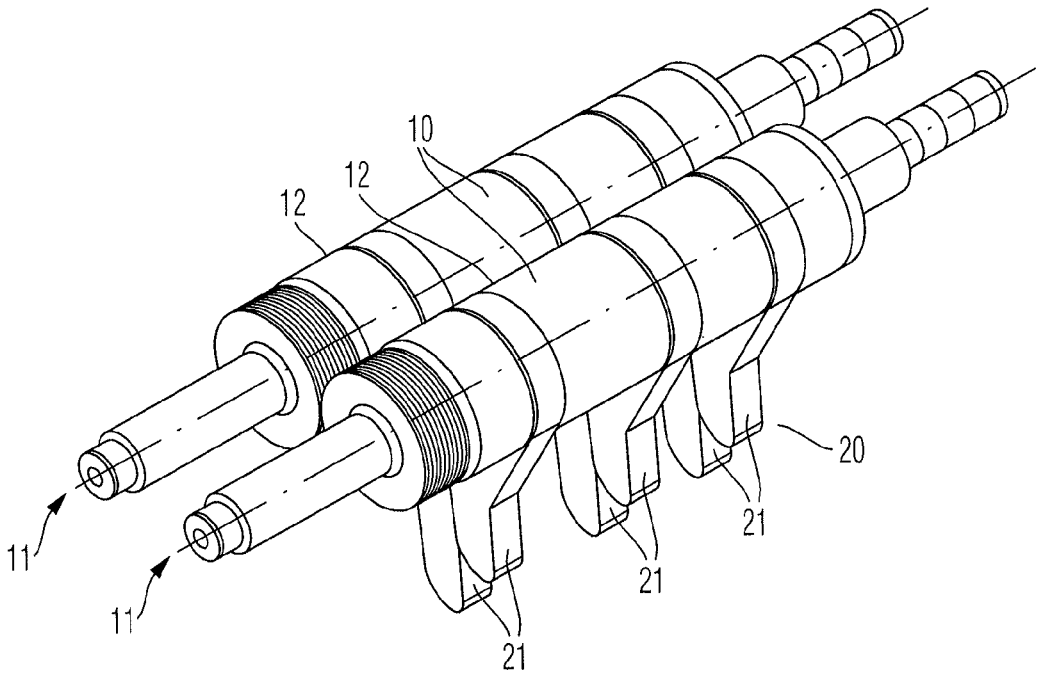
FIG. 2 is a three-dimensional representation of a folding roller pair consisting of two folding rollers with associated belt line.

FIG. 2 shows the folding roller pair consisting of two folding rollers 10 rotating in opposite directions about the respective axis of rotation 11. In addition, the belt line 20 which ensures the transport of the product to be folded, is shown in FIG. 2. The belt line 20 consists of at least one transport belt 21 each, which is driven by the rotation of the folding roller 10, clamps the folded product or product to be folded between the two transport belts 21 and transports the same by frictional connection. For this reason, a transport belt generally has a higher coefficient of friction than the outer shell surface of the folding roller body 12. Preferentially, multiple transport belts 21 are employed over the length of the folding roller 10 and thus over the maximum width of the product to be folded, whereby these transport belts 21 in axial extension of the folding roller 10 are located on both folding rollers 10 in the same position, so that the respective opposite transport belts 21 can clamp the product to be folded. In the shown example, three transport belts 21 are employed over the width of a folding roller 10.

Figure 3:
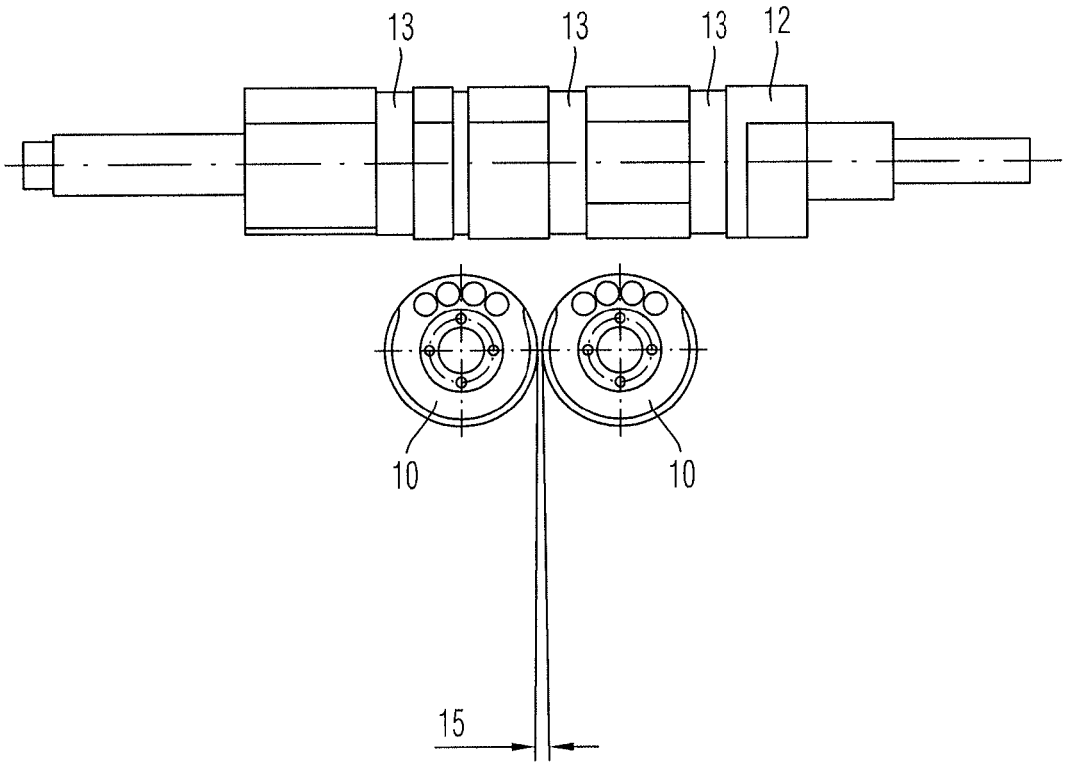
FIG. 3 is a two-dimensional representation of a folding roller pair with shown folding roller nip.

FIG. 3 shows the folding roller body 12 of the folding rollers 10 in lateral and front view; it shows that in the regions of axial extension, in which the transport belts 21 are positioned and at least partially wrap the folding roller, a groove 13 each is present.

The low thickness of the transport belts 21 and the stiffness in the radial direction of the folding roller 10 resulting from this produces a low flexibility or elasticity so that the roller nip 15 has to be exactly adjusted to the respective thickness of the product to be folded. The dimension for the roller nip 15 approximately corresponds to the thickness of the finished folded product, which is obtained from the number of the substrate layers and the thickness of the substrate.

However, the adjustment of the roller nip 15 also depends on the shell surface condition of the folding roller 10, of the transport belts 21 but also of the shell surface and of the friction characteristic of the substrate. Accordingly, when adjusting the roller nip 15 appropriate care is required for a roller nip adjusted too narrowly results in damage of the product to be folded such as marks, abrasion or even transverse folds. In an extreme case, the product to be folded is not pulled through the folding roller nip and remains on the folding table 4 of the folding device 1 resulting in so-called stoppers. Furthermore, an adjustment of the roller nip 15 that is too narrow results in increased wear of the transport belts 21, of the folding knife 3 or even of the folding rollers 10. With a folding roller nip 15 that is adjusted too large, the product to be folded is not gripped by the folding rollers 10 or the transport belts 21 and is likewise not reliably pulled through the roller nip 15, which can likewise result in stoppers and thus production interferences.

With the folding rollers 10 known from the prior art, the transport belts 21 are subjected to wear as a result of which on the one hand the friction coefficient of the transport belts 21 and on the other hand the folding away-characteristic changes since the wear of the transport belt 21 results in a low protrusion of a transport belt 21 relative to the outer shell surface of the folding roller body 12.

Figure 4:
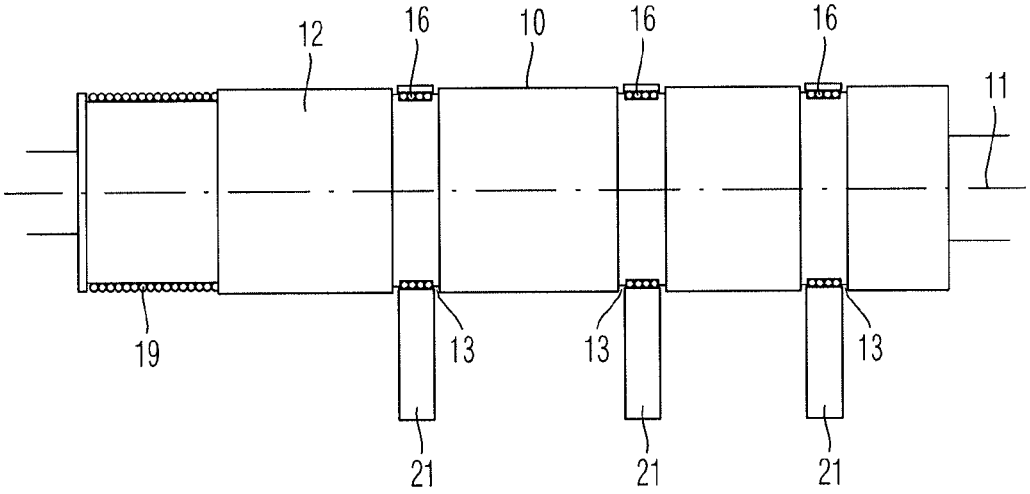
FIG. 4 is a folding roller according to the invention without transport belts, but with rubber-elastic inserts.

FIG. 4 shows a configuration of a folding roller 10 according to the invention, which in the regions in axial extension, in which the transport belts 21 wrap the folding roller 10 at least partially, at least one rubber-elastic insert 16 is provided on the folding roller 10 in each case. Here, the circumferential grooves 3 in the folding roller body 12 are matched to the thickness of the insert 16 and of the transport belt 21 in the manner that the transport belt has a protrusion of approximately 0.05 to 0.5 mm—dependent for example on the elasticity of the insert 16 and for example the friction coefficient of the transport belt 21 employed—relative to the outer shell surface of the folding roller 10. The transport belts 21, in the case of the folding roller 10 according to the invention, no longer run directly on the folding roller body 12, but on the rubber-elastic insert 16. This produces a flexibility of the transport belt 21 in the radial direction of the folding roller 10, which reduces the wear of the transport belts 21 and at the same time renders the adjustment of the folding roller nip 15 no longer so sensitive. Accordingly, the risk of damage to the print products can be reduced and the production safety increased by avoiding stoppers.

Another configuration of the invention which is not shown by the FIG. 4 is that the folding roller 10 according to the invention does not have a rubber-elastic insert 16 in each region in which a transport belt 21 at least partially wraps the folding roller, but a rubber-elastic insert 16 only attached in at least one region in which a transport belt 21 at least partially wraps the folding roller 10.

In the case of the exemplary configuration of a folding roller 10 according to the invention shown in FIG. 4 in the regions of an axial extension, in which a transport belt 21 at least partially wraps the folding roller 10, a circumferential groove 13 is embodied. This circumferential groove 13 in the folding roller body 12 can be embodied as a circumferential insert groove 19 in which the rubber-elastic insert 16 is positioned.

However it is also possible to embody the circumferential groove 13 in the form that the circumferential insert groove 17 is only a part of the circumferential groove 13 and the circumferential groove in addition to the circumferential insert groove 17 has a circumferential transported belt groove 14. In a groove 13 that is embodied offset in such a manner the rubber-elastic insert is positioned in the region of the groove that is radially inside, i.e., in the insert groove 17, whereas the transport belt groove 14 located radially outside serves for guiding a transport belt 21 in the axial direction. In this configuration, the outer shell surface of the folding roller body 12 protrudes over the outer enveloping shell surface of the rubber-elastic insert 16 and the respective transport belt 21 projects into the circumferential groove 13.

In the case of the folding roller 10 shown in FIG. 4, exemplarily four closed rings or rubber-elastic material with circular cross-section are shown as insert 16 for a transport belt 21, which however corresponds only to one embodiment, for as insert 16, an annular structure or any number of annular structures can also be employed in each case.

Furthermore, there are various possibilities when selecting the materials of the inserts 16: accordingly, inserts 16 of compressible material can be employed or incompressible materials can be used for this purpose. The choice of suitable material in this case is based on the one hand on the combination of the materials for transport belts 21, insert 16 and the substrate to be folded as well as the geometry such as for example the cross-section of the insert 16 and of the groove 13. Furthermore, the choice is also dependent on the configuration of the insert 16.

In the shown example of FIG. 4, multiple rings closed as inserts made from rubber-elastic material such as for example NBR-70 or polyurethane are employed. Dependent on the dimensions of the groove 13 and of the transport belt 21 used, a single ring of rubber elastic material can however be used as insert 16. This ring or these rings are pushed onto the folding roller 10 from the face end in the axial direction. In the process, the folding roller 10 need not be removed from the mounting shown in FIG. 4. However, since the inserts 16 are subject to a certain wear a region of limited axial extension is formed as stocking 19 of at least one insert 16 or preferentially of multiple inserts 16 on the folding roller 10 which preferentially does not come into contact with the product to be folded during the folding operation. This stocking 19 of inserts 16 has the advantage that in the case of wear of the insert 16 and thus for the replacement of the same, the folding roller 10 does not have to be removed from the mounting shown since for replacing an insert 16 the same is cut open—if this is still required, so that the worn insert 16 can be removed, a new insert 16 is pushed in the axial direction of the folding roller 10 into the appropriate position in a groove 13 from the region of the stocking 19 of inserts 16.

In a further advantageous embodiment of the invention which is not shown, multiple regions formed as stocking 19 can also be embodied in axial extension of the folding roller 10.

FIG. 5 shows an embodiment in which the transport belt 21 lies on an insert 16 over the entire width. To neatly position or guide insert 16 and transport belt 21, the groove 13 is advantageously embodied in an offset manner. Accordingly, the groove 13 consists of a transport belt groove 14 located as seen in the radial direction on the outside and an insert groove 17 located as seen in the radial direction further inside. However, such an embodiment is not absolutely necessary provided the transport belt 21 is otherwise guided in the correct axial position.

Figure 5A:
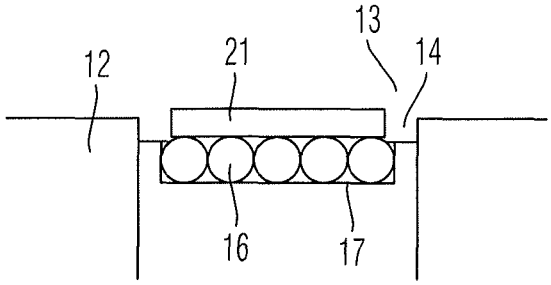
FIGS. 5*a-c* illustrates possible configurations of the rubber-elastic inserts, wherein the transport belt lies on the insert over its entire width.
Figure 5B:
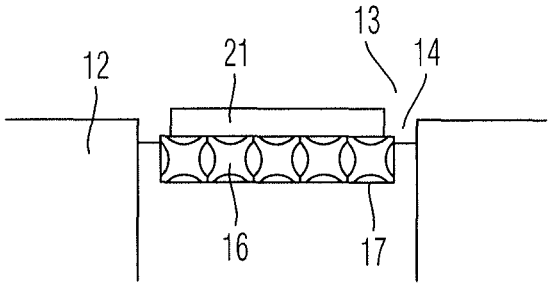

While FIG. 5*a* shows inserts 16 with circular cross-section, inserts 16 with polygonal cross-section are shown for example in FIG. 5*b*. This example illustrates that as insert 16 rings with different cross-sections can be employed. This increases the choice of commercially available rings or rubber-elastic material which preferentially have a hardness of approximately 25 to approximately 100 shore.

Figure 5C:
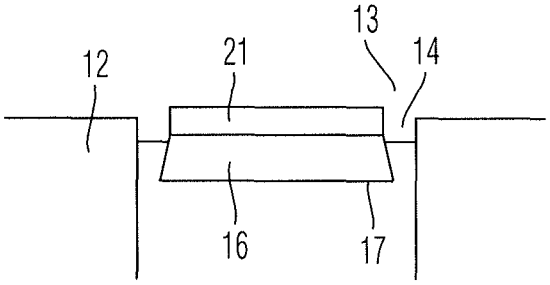

While in FIGS. 5*a* and 5*b* inserts 16 of closed, in other words endless rings are shown, an embodiment of an insert 16 is exemplarily shown in FIG. 5*c* which can also be produced from a strip of rubber-elastic material with finite extension. The reason is that such a configuration of an insert 16 has the advantage that for replacing the insert 16 the folding roller 10 need not be removed from the shown mounting since such an insert 16 can be applied onto the folding roller 10 in the radial direction from the outside. Preferentially, the strip-shaped insert 16 of FIG. 5*c* has a length which corresponds to the circumference of the neutral fiber in the assembled state on the folding roller 10. Accordingly, the insert 16 in this configuration has a joint seen in the circumferential direction but this is not a disadvantage in the case of clocked folding rollers.

Advantageously, the insert groove 17 in this configuration of the insert 16 is configured in such a manner that for clamping the rubber-elastic insert 16 additional fixing elements can be omitted. This is achieved for example in that the circumferential insert groove 17 for receiving the insert 16 has a cross-section which, seen in the radial direction, has a cross-section diminishing towards the outside, which for example can have a trapezium-like shape. Preferably, but not absolutely necessarily, compressible materials such as for example foamed polyurethanes are employed with such a configuration of the insert 16.

Alternatively, to ensure the fixed position of the insert 16 on the folding roller 10, an additional fixing element such as for example an adhesive substance can also be employed.

Figure 6A:
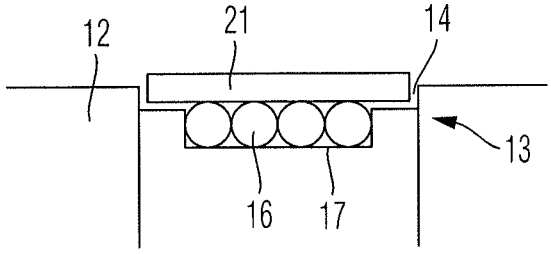
FIGS. 6*a-c* illustrate possible configurations of the rubber-elastic inserts, wherein the transport belt over its width lies on the insert only partially.
Figure 6B:
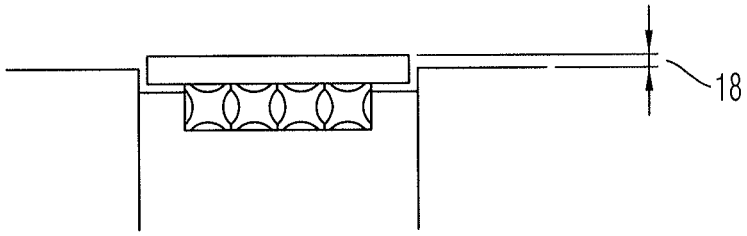
Figure 6C:
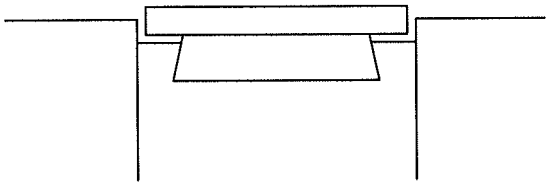

FIGS. 6*a*, 6*b* and 6*c* show a configuration of the invention in which a transport belt 21 over its width lies only partially on a respective insert 16. Such a configuration has the advantage that by neatly demarcating the transport belt groove 14 and the insert groove 17 optimal guidance of the transport belt 21 is ensured.

Figure 7A:
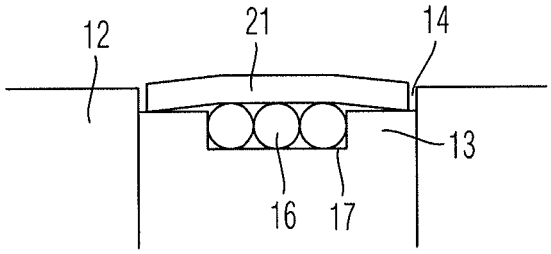
FIGS. 7*a-c* illustrate possible configurations of the rubber-elastic inserts, wherein the transport belt over its entire width lies on the insert and in the region of the wrap forms a calotte-shaped outer shell surfaces.
Figure 7B:
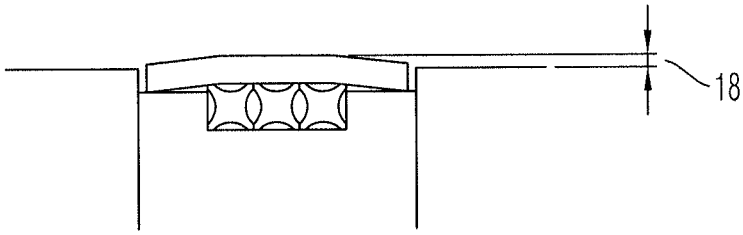
Figure 7C:
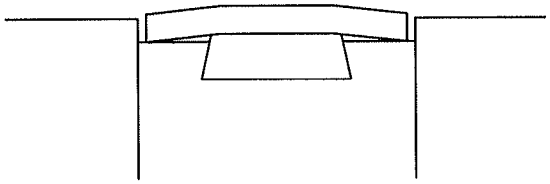

FIGS. 7*a*, 7*b* and 7*c* show an embodiment in which a transport belt 21 over its width lies on a rubber-elastic insert 16 with merely a relatively small portion. Through this variation of the width of the insert 16, the resilience and thus the elasticity of the insert 16 can be varied with the same material or with the same commercially available rings employed. Thus, it is either possible for different products to be folded, i.e., for example for folding products from different materials or for example for products to be folded of different thickness, to use or provide different types of folding rollers 10 with inserts 16 of different width thereby with different elasticity without having to stock different rings as wear parts.

A particular configuration of the folding roller 10 according to the invention is using inserts 16 of different width in axial extension of the folding roller 10, which in particular seen in axial extension of the folding roller is advantageous in the case of asymmetrical folding products.

As is evident from FIGS. 5 to 7, a combination of different folding rollers 10 with different inserts 16 or even the combination of folding rollers 10 with inserts 16 and folding rollers 10 without inserts is likewise possible and advantageous in particular dependent on the peripheral parameters of the product to be folded.

Figure 8:
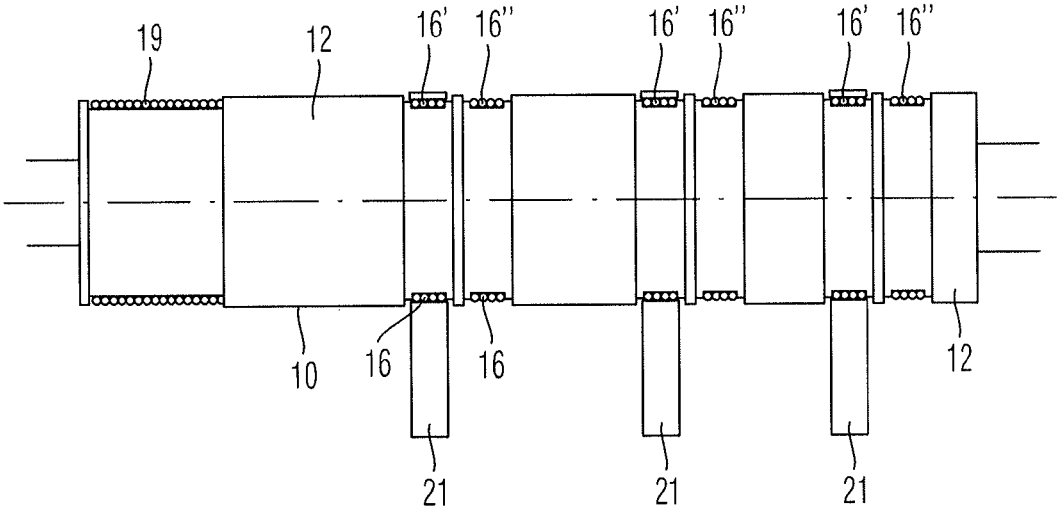
FIG. 8 illustrates a possible embodiment of the folding roller according to the invention with rubber-elastic inserts in first and second regions.

FIG. 8 shows a further advantageous form of a folding roller 10 according to the invention in which in addition to the insert or inserts 16 in first regions 16' in axial extension, on which the transport belts 21 at least partially wrap the folding roller 10 and which have a circumferential groove 13 and an insert 16 introduced therein, a second region 16" is provided on the folding roller 10, which likewise has a circumferential groove 13 with an insert 16 introduced therein. Advantageously, but not absolutely necessarily, the inserts of the second regions 16" are arranged in relative proximity next to the inserts of the first regions 16'. The distance however should be configured at least in such a manner that in the first region 16' and in the second region 16" transport belts 21 can run simultaneously in order to ensure an adequate distance of the first regions 16' from the second regions 16". This configuration offers the advantage that in the case of a worn insert in a first region 16' the relative transport belt 21 only has to be repositioned laterally into the relevant second region 16" so that the maintenance efforts are thereby additionally minimized and the availability additionally increased, in particular when this embodiment is embodied combined with the stocking 19 of inserts 16. A requirement of this embodiment is that the two transport belts 21 of both folding rollers 10 corresponding in axial extension are relocated from a first region 16' into a second region 16" or vice versa and the belt line 20 for avoiding the lateral runoff in the region downstream of the folding rollers 10 next to guide elements in alignment with the first regions 16' have additional guide elements aligned with the second regions 16".

A particularly advantageous configuration of the invention is that the width and/or the elasticity of the insert of the first regions 16' differs from the width and/or the elasticity of the insert of the second regions 16" since because of this embodiment of the folding roller 10 according to the invention the elasticity and thus the folding or conveying behavior of the folding rollers 10 can be exclusively adapted to the respective substrate or the product to be folded by laterally repositioning the transport belts 21 and thus without replacing the folding roller 10 or the inserts 16.

LIST OF REFERENCE NUMBERS

1 Folding device
2 Folding drum
3 Folding knife
4 Folding table
10 Folding roller
11 Axis of rotation
12 Folding roller body
13 Groove
14 Transport belt groove
15 Roller nip
16 Insert
16' First region
16" Second region
17 Insert groove
18 Projection transport belt
19 Stocking
20 Belt line
21 Transport belt
30 Paddle wheel
31 Delivery belt The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A folding roller, comprising:

a cylindrical folding roller body, wherein the folding roller body has a circumferential insert groove that is part of a circumferential groove which, in addition to the circumferential insert groove, has a circumferential transport belt groove;

a transport belt, wherein the transport belt is guided on the cylindrical folding roller body in an axial region of the cylindrical folding roller body; and a rubber-elastic insert disposed on the axial region, wherein the rubber-elastic insert is disposed in the circumferential insert groove.

2. The folding roller according to claim 1, wherein the rubber-elastic insert has a width such that the transport belt lies at least partially on the rubber-elastic insert.

3. The folding roller according to claim 1, wherein an outer shell surface of the folding roller body protrudes over an outer shell surface of the rubber-elastic insert and wherein the transport belt projects into the circumferential groove.

4. The folding roller according to claim 1, wherein the rubber-elastic insert is a compressible material.

5. The folding roller according to claim 1, wherein the rubber-elastic insert is an incompressible material.

6. The folding roller according to claim 1, wherein the rubber-elastic insert is an endless ring of rubber-elastic material.

7. The folding roller according to claim 6, wherein the endless ring has a circular or polygonal cross-section.

8. The folding roller according to claim 1, wherein the folding roller has a region in limited axial extension which is not covered by a transport belt and wherein a second rubber-elastic insert is stocked in the region in limited axial extension.

9. The folding roller according to claim 1, wherein the rubber-elastic insert is a strip of finite length of rubber-elastic material and wherein the finite length corresponds to a length of a circumference of a neutral fiber in an assembled state on the folding roller.

10. The folding roller according to claim 1, wherein the circumferential insert groove has a cross-section such that no fixing element is used for clamping the rubber-elastic insert in the circumferential insert groove.

11. The folding roller according to claim 10, wherein the circumferential insert groove has a cross-section that diminishes in an outward radial direction.

12. The folding roller according to claim 1, wherein the rubber-elastic insert has a hardness of approximately 25 to approximately 100 shore.

13. The folding roller according to claim 1, further comprising:

a second rubber-elastic insert disposed on a second axial region of the cylindrical folding roller body;

wherein the second axial region is adjacent to the axial region.

14. The folding roller according to claim 13, wherein a width and/or an elasticity of the rubber-elastic insert differs from a width and/or an elasticity of the second rubber-elastic insert.

* * * * *